United States Patent [19]

Eckles et al.

[11] 4,270,989

[45] Jun. 2, 1981

[54] CADMIUM PLATING BATHS AND METHODS FOR ELECTRODEPOSITING BRIGHT CADMIUM DEPOSITS

[75] Inventors: William E. Eckles; Charles W. McFarland, both of Cleveland Heights, Ohio

[73] Assignee: Rohco, Inc., Cleveland, Ohio

[21] Appl. No.: 106,094

[22] Filed: Dec. 21, 1979

[51] Int. Cl.[3] ..... C25D 3/26

[52] U.S. Cl. ..... 204/50 R; 204/DIG. 2

[58] Field of Search ..... 204/50 R, DIG. 2, 50 Y

[56] References Cited

U.S. PATENT DOCUMENTS

| | | | |
|---|---|---|---|
| 2,389,181 | 11/1945 | Brown | 204/50 R |
| 3,787,296 | 1/1974 | Hyashida et al. | 204/55 R |
| 4,075,066 | 2/1978 | Eckles et al. | 204/55 R |

FOREIGN PATENT DOCUMENTS

| | | | |
|---|---|---|---|
| 973423 | 10/1964 | United Kingdom | 204/49 |

*Primary Examiner*—G. L. Kaplan

*Attorney, Agent, or Firm*—Maky, Renner, Otto & Boisselle

[57] ABSTRACT

Cadmium electroplating baths are described which contain at least one phosphate, carboxylate, sulfonate or sulfate compound containing one or more alkylene oxide groups containing 2 or 3 carbon atoms and wherein at least one of the alkylene oxide groups in the sulfates is attached to an aryl group. The baths also can contain at least one organic brightener compound and particularly pyridine brightener compounds having the formula:

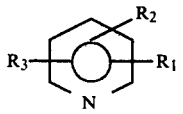

wherein $R_1$, $R_2$ and $R_3$ are each independently hydrogen, alkyl, alkoxy, alkene, mercapto, amino, halogen, aryl, arylalkyl, aminoalkyl, hydroxy, hydroxyalkyl, cyano, dialkylamide, aldoxime, benzo (b), pyrrolidinyl groups and the corresponding N-oxide compounds. Semi-bright to bright level cadmium coatings are obtained with these baths.

28 Claims, No Drawings

CADMIUM PLATING BATHS AND METHODS FOR ELECTRODEPOSITING BRIGHT CADMIUM DEPOSITS

BACKGROUND OF THE INVENTION

The invention relates to the electrodeposition of cadmium and, particularly to a plating bath for plating bright level cadmium deposits from aqueous acid cadmium baths. More particularly, the invention relates to the incorporation into the acid cadmium baths of at least one polyalkylene oxide containing phosphate, carboxylate, sulfonate or sulfate compound. The invention also relates to methods for electrodepositing level and bright cadmium deposits from such baths.

A variety of plating baths have been developed and employed for electroplating cadmium onto metallic substrates. These baths typically utilize sulfates and cyanides as the primary electrolytes. The cyanide baths have proven effective and generally satisfactory despite certain objectionable features such as high toxicity, low current efficiency and hydrogen embrittlement of certain steels. The sulfate baths which have been suggested overcome many of the objectionable features of the cyanide baths. However, some of the sulfate-based baths contain such components as ammonium ions and chelating agents. Because of the ability of these agents to complex with heavy metal ions, there is a significant increase in the difficulty of eliminating heavy metals from spent baths. Sulfate-based baths which do not utilize ammonium ions or chelating agents have more recently been suggested in the prior art. For example, in U.S. Pat. No. 3,998,707, an aqueous acidic cadmium electrolytic bath composition is described which comprises cadmium ions, free acid, and a particular surfactant combination which comprises a cationic polyoxyalkylated amine and an anionic surfactant. Preferably the cadmium plating bath also contains at least one brightener. Examples of brighteners include aryl aldehydes such as anisic aldehyde, ring halogenated aryl aldehydes such as orthochlorobenzaldehyde, heterocyclic aldehydes such as thiophenealdehyde, aryl olefinic-conjugated ketones such as benzylidine acetone, and heterocyclic carboxylic acids such as nicotinic acid. The combination of orthochlorobenzaldehyde and benzoyl pyridine is shown in Example 3. Similarly, U.S. Pat. No. 4,045,305 describes cadmium plating baths which contain cadmium ions, free acid, a surfactant combination comprising a condensed naphthalene sulfonate compound and a non-ionic polyoxyalkylated surfactant. Preferably this bath also contains a brightener of the type described in U.S. Pat. No. 3,998,707.

SUMMARY OF THE INVENTION

The present invention relates to the discovery that a bright and level cadmium electrodeposit can be obtained from aqueous acid plating baths containing cadmium ions, free acid and at least one compound selected from the group consisting of phosphates, carboxylates, sulfonates and sulfates containing at least one polyoxyalkylene group. Generally the bath also contains at least one organic brightener composition, preferably, at least one pyridine brightener composition having the formula

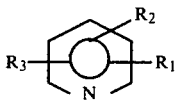

(I)

wherein $R_1$, $R_2$ and $R_3$ are each independently hydrogen, alkyl, alkoxy, alkene, mercapto, amino, halogen, aryl, arylalkyl, aminoalkyl, hydroxy, hydroxyalkyl, cyano, dialkylamide, aldoxime, benzo (b), pyrrolidinyl groups and the corresponding N-oxide compounds.

The acid cadmium plating baths of the invention also may contain, and preferably contain, at least one aromatic sulfonic acid or condensed aromatic sulfonic acid. The plating baths of the invention are effective over a wide current density range.

DESCRIPTION OF THE PREFERRED EMBODIMENTS

The cadmium plating baths of the present invention comprise cadmium ions, free acid and at least one phosphate, carboxylate, sulfonate or sulfate containing at least one polyoxyalkylene group. Preferably the baths also contain at least one organic brightening agent which is preferably a pyridine compound as hereinafter defined.

The cadmium ion in the plating bath can be supplied from bath soluble compounds such as cadmium sulfate, cadmium fluoborate and cadmium oxide. The cadmium oxide forms a soluble cadmium salt in combination with the ions otherwise introduced into the plating bath. The plating baths may contain from about 5 to about 75 grams per liter of cadmium ions and preferably contains from about 8 to about 50 grams per liter.

The free acid utilized in the preparation of the plating baths of the invention preferably are either sulfuric or fluoboric acid or mixtures thereof, and the amount of free acid incorporated into the bath may range from about 50 to 175 grams per liter, and is preferably from about 75 to about 160 grams per liter. The plating baths of the invention also contain at least one anionic compound selected from the group consisting of aromatic or aliphatic sulfonic acids, aliphatic sulfates, and bath-soluble salts thereof.

The plating baths of the invention also contain at least one phosphate, carboxylate, sulfonate, or sulfate compound containing one or more polyalkylene oxide groups wherein the alkylene group contains 2 or 3 carbon atoms, and at least one of the alkylene oxide groups in the sulfates is attached to an aryl group. With the exception of the restriction placed on the sulfates, the polyalkylene groups may be derived from a wide variety of compounds which may be of the nonionic or cationic type. In general, the phosphate compound will have the general formula

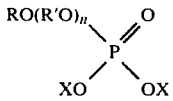

(II)

wherein

R is an alkyl or aryl group containing up to about 24 carbon atoms, each R' independently is an alkylene group or mixture of alkylene groups containing 2 or 3 carbon atoms, n is an integer from one to about 100, and each X independently is hydrogen, a metal, ammonium or protonated amine, or each OX independently is $RO(R'O)_n$—.

The carboxylate compounds useful in the cadmium plating solutions of the invention will correspond to the formula $$RO(R'O)_nR''COOX \quad (III)$$

wherein

R is an alkyl or aryl group containing up to about 24 carbon atoms,

R' is an alkylene group or mixture of alkylene groups containing 2 or 3 carbon atoms, R'' is an alkylene group containing from one to about 20 carbon atoms, n is an integer from one to about 100, and X is hydrogen, a metal, ammonium or a protonated amine.

The sulfate compounds which are useful in the plating baths of the invention generally will have the formula $$RO(R'O)_n—SO_2—Y \quad (IV)$$

wherein

R is an aryl or alkylaryl group,

R' independently is an alkylene group or mixture of alkylene groups containing 2 or 3 carbon atoms, n is an integer from one to about 100, and Y is $RO(R'O)_n$ or OM wherein M is hydrogen, a metal, ammonium or a protonated amine.

One method of preparing the phosphates, sulfonates and sulfates described above is by reacting a polyalkylene oxide compound having the general formula $RO(R'O)_n$—H wherein R is an alkyl or aryl group, R' is an alkylene group and n is an integer from one to about 100 with a phosphoric or sulfuric acid. The carboxylate compounds can be prepared by reacting such polyalkylene oxide compounds with, for example, a monohalocarboxylic acid. The acidic hydrogen atom or atoms of the products of these reactions can be replaced with a metal, ammonium, or a protonated amine by reactions well known in the art to form the respective salts. The polyalkylene oxide compounds may be nonionic or cationic alkylene oxide condensate compounds, and examples of such compounds include ethoxylatd alkyl phenols, ethoxylated naphthols, ethoxylated fatty alcohols, ethoxylated fatty acids, ethoxylated fatty acid amides, ethoxylated fatty amines, polyethylene oxide condensates, block copolymers of ethylene oxide and propylene oxide based on propylene glycol or ethylene glycol, and sulfonated ethoxylated aliphatic amines. The aryl groups in the above compounds can contain one or more anionic groups attached to the ring such as a sulfonic acid group. The propoxylated derivatives also can be used. These compounds can contain up to about 100 or more ethylene and/or propylene oxide units and generally will contain up to 40 such units.

The alkoxylated alkyl phenols may be represented by the formula

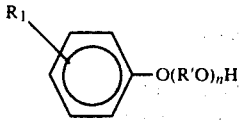

(V)

wherein $R_1$ is an alkyl group containing up to about 20 carbon atoms, R' contains 2 or 3 carbon atoms and n is an integer from about 10 to about 30. Preferably the alkyl group contains from about 6 to 20 carbon atoms. Examples of such alkyl groups include octyl, isooctyl, nonyl, dodecyl, octadecyl. Ethoxylated alkyl phenols are available commercially under a variety of trademarks such as "Surfonic" from Jefferson Chemical Co., "Renex" from Atlas Chemical Industries, Inc., and "Igepal" from GAF Corporation Chemical Products.

The polyoxyalkylated naphthols are obtained by reacting a naphthol with an alkylene oxide such as ethylene oxide and propylene oxide, and more particularly, with from about 6 to about 40 moles of ethylene oxide per mole of naphthol. The naphthol reactant may be either alpha or beta naphthol and the naphthalene ring may contain various substituents such as alkyl groups or alkoxy groups, especially lower alkyl and lower alkoxy groups of up to about 7 carbon atoms each, so long as the polyoxyalkylated naphthol remains bath-soluble. When present, there usually will not be more than two such substituents per polyoxyalkylated naphthol; that is, two lower alkyl groups, or a lower alkyl or a lower alkoxy group. The preferred polyoxyalkylated naphthols are ethoxylated naphthols having the formula

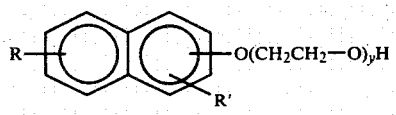

(VI)

wherein y is from about 6 to about 40 and preferably from about 8 to about 20 and R and R' are each independently hydrogen, alkoxy, or alkyl groups containing up to 7 carbon atoms. Derivatives of beta naphthol are preferred.

Alkoxylated aliphatic alcohols which are useful may be characterized by the formula $$RO(R'O)_n—H \quad (VII)$$

wherein R is an alkyl group containing from about 8 to 24 carbon atoms, R' is an alkylene group of 2 or 3 carbon atoms and n is an integer of from 5 to about 30. Fatty alcohols such as oleyl and stearyl are preferred examples. A number of ethoxylated aliphatic alcohols are available commercially such as from Emery Industries under the general trademark "Trycol". A specific example is "Trycol OAL-23" which is an ethoxylated oleyl alcohol.

The alkoxylated fatty acids may be represented by the formula $$RC(O)—O(R'O)_nH \quad (VIII)$$

and the alkoxylated fatty acid amides represented by the formula $$RC(O)—N(H)(R'O)_nH \text{ or} \quad (IX)$$

$$RC(O)—N[(R'O)_n—H]_2 \quad (IXa)$$

wherein R is an alkyl carbon chain containing from about 8 to 24 carbon atoms, R' contains 2 or 3 carbon atoms and n is an integer from about 5 to about 20. The reaction of some alkoxylated fatty acids and amides with phosphoric and sulfuric acid may, in some instances, result in a hydrolysis or partial hydrolysis of the compounds which may have an effect on the utility of these compounds.

The alkoxylated fatty acids can be obtained by reacting ethylene or propylene oxide with a fatty acid such as oleic acid, stearic acid, palmitic acid, etc. The ethoxylated fatty acids are available commercially such as from Armak Industries, Chemical Division under the trademark "Ethofat". Specific examples are: Ethofat C/15, coco acid ethoxylated with 5 moles of ethylene oxide, and Ethofats O/15 and O/20, which are oleic acid reacted with 5 and 10 moles of ethylene oxide respectively. The alkoxylated fatty acid amides can be obtained by reacting ethylene or propylene oxide with a fatty acid amide such as oleamide, stearamide, coconut fatty acid amides and lauric amide. The ethoxylated fatty acid amides, which may also be identified as ethoxylated alkylolamides are commercially available from, for example, The Stepan Chemical Company under the general trade designation Amidox, and from Armak under the trademark ETHOMID.

Another type of nonionic ethoxylated compound which is useful in the invention is block copolymers of ethylene oxide and propylene oxide based on a glycol such as ethylene glycol or propylene glycol. The copolymers based on ethylene glycol generally are prepared by forming a hydrophilic base by reaction of ethylene oxide with ethylene glycol followed by condensation of this intermediate product with propylene oxide. The copolymers based on propylene glycol similarly are prepared by reacting propylene oxide with propylene glycol to form the intermediate compound which is then condensed with ethylene oxide. By varying the proportions of ethylene oxide and propylene oxide used to form the above copolymers, the properties may be varied. Both of the above types of copolymers are available commercially such as from BASF Wyandotte under the general trademark PLURONIC. The condensates based on ethylene glycol are identified as the "R" series, and these compounds preferably contain from about 30 to about 80% of polyoxyethylene in the molecule and may be either liquids or solids. The condensates based on propylene glycol are identified generally by BASF Wyandotte as the "F", "L", or "P" series and these may contain from about 5 to about 80% of ethylene oxide. The "L" series of propylene glycol based copolymers are liquids, the "F" series are solids and the "P" series are pastes. The solids and pastes can be used when they are soluble in the bath formulation. The molecular weights of these block copolymers range from about 400 to about 14000.

The ethoxylated amines and particularly the ethoxylated fatty amines which are useful can be prepared by condensing ethylene oxide with fatty amines by techniques known to those in the art. The alkoxylated amines which may be utilized in the plating baths of the invention may be represented by the following formulas

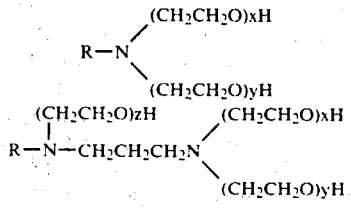

(X)

(XI)

wherein R is a fatty amine alkyl group containing from 8 to 22 and preferably 12 to 18 carbon atoms, and x, y and z are each independently integers from 1 to about 30, and the sum of x, y and z is an integer of from 3 to about 50. The ethoxy group can be replaced by a propoxy group.

The above described alkoxylated amines are known in the art and are available from a variety of commercial sources. The amines of the type represented by formula X can be prepared by condensing various amounts of ethylene oxide with primary fatty amines which may be a single amine or a mixture of amines such as are obtained by the hydrolysis of tallow oils, sperm oils, coconut oils, etc. Specific examples of fatty amines containing from 8 to 22 carbon atoms include saturated as well as unsaturated aliphatic amines such as octyl amine, decyl amine, lauryl amine, stearyl amine, oleyl amine, myristyl amine, palmityl amine, dodecyl amine and octadecyl amine.

The above described amines can be prepared, as mentioned above, by condensing alkylene oxides with the above-described primary amines by techniques known to those in the art. A number of such alkoxylated amines is commercially available from a variety of sources. The alkoxylated amines of the type represented by formula X are available from the Armak Chemical Division of Akzona, Inc., Chicago, Ill., under the general trade designation "Ethomeen". Specific examples of such products include "Ethomeen C/15" which is an ethylene oxide condensate of a coconut fatty amine containing about 5 moles of ethylene oxide; "Ethomeen C/20" and "C/25" which are also ethylene oxide condensation products from coconut fatty amine containing about 10 and 15 moles of ethylene oxide respectively; "Ethomeen S/15" and "S/20" which are ethylene oxide condensation products with stearyl amine containing about 5 and 10 moles of ethylene oxide per mole of amine respectively; and "Ethomeen T/15" and "T/25" which are ethylene oxide condensation products of tallow amine containing about 5 and 15 moles of ethylene oxide per mole of amine respectively. Commercially available examples of alkoxylated amines of the type represented by formula XI include "Ethoduomeen T/13" and "T/20" which are ethylene oxide condensation products of N-tallow trimethylene diamine containing about 3 and 10 moles of ethylene oxide per mole of diamine respectively.

As mentioned above, the phosphate, sulfonate and sulfate compounds can be prepared by reacting the above-described polyalkylene oxide compounds with a phosphoric or sulfuric acid in the amounts required to produce the desired products. The reaction between the terminal hydroxyl group of the polyalkylene oxide compound and the phosphoric or sulfuric acid proceeds without difficulty to provide the desired product. Methods of preparing organic sulfonates which can be utilized in the preparation of the sulfonates of the invention are described in, for example, *Synthetic Organic Chemistry,* Wagner & Zook, John Wiley & Sons, Inc., New York, 1953, pages 811–12; Weygand/Hilgetag, *Preparative Organic Chemistry,* Hilgetag & Martini, Editors, John Wiley & Sons, Inc., New York, 1972, pages 612–23; and Vogel's: *Textbook of Practical Organic Chemistry,* 4th Ed., Longman & Gruber Ltd., London, pages 640–645. The preparation of organic compounds containing phosphate groups is described in Weygand-/Hilgetag: *Preparative Organic Chemistry,* Hilgetag & Martini, Editors, John Wiley & Sons, New York, 1972, pages 709–16. Methods of preparing organic carboxylate compounds which can be useful in the invention are described at pages 945–946 of *Preparative Organic Chemistry* and on pages 789–92 of the *Survey of Organic Syntheses,* Buehler & Pearson, Wiley-Interscience, New York, 1970, and on pages 227–8, 425–6 and 434 of *Synthetic Organic Chemistry,* Wagner & Zook, John Wiley & Sons, New York, 1953. Such discussions in these texts are hereby incorporated by reference.

One of the useful methods of preparing the polyalkylene oxide compounds containing carboxylate groups which are useful in the present invention is by reacting a polyalkylene oxide compound with a monohalo organic carboxylic acid containing from one to about 20 carbon atoms. A preferred example of such a halocarboxylic acid is chloroacetic acid.

As indicated above with respect to phosphates having the formula II, the phosphate compounds may be either the mono, di or triesters of phosphoric acid. Preferably, the phosphate is a mono or diester of phosphoric acid or the metal, ammonium or protonated amine salt of said phosphoric acid. The carboxylate compounds preferably are the alkali metal salts of carboxylic acids represented by formula III.

The sulfate compounds which are useful in the plating baths of the invention can contain either one or two polyoxyalkylene groups as represented by formula IV, and when R is an aryl group, the aryl group may contain a sulfonic acid group and such compounds in fact contain a sulfate and a sulfonate group. The preferred sulfate compounds are the ammonium and/or alkali metal salts of sulfates containing only one polyoxyalkylene group.

The preferred phosphate esters useful in the plating baths of the invention are those represented by formula II above, the compounds of the type represented by formula II are available from a variety of commercial sources including GAF Corporation, New York. The GAF Corporation offers a series of complex organic phosphate esters of the type represented by formula II under the general trade designation "Gafac".

Carboxylates of the type represented by formula III are available commercially. One group of such carboxylates is available from Hart Products Corp. under the general trade designation "Carbanone". The Carbanones have the general structure $$RR'—C(H)—O(CH_2CH_2—O)_nCH_2COO^-M^+$$

wherein n is an integer, M is an alkali metal and R and R′ are each independently lower alkyl groups containing one to 6 carbon atoms. One method of preparing such compounds is the reaction of monochloroacetic acid with the compound obtained by ethoxylating a secondary alcohol.

The sulfonate and sulfate compounds generally may be derived by known sulfonation and sulfation reactions with polyoxyalkylene compounds of the type described above. At least one of the polyoxyalkylene compounds in the sulfates which are useful in the baths of the invention will include an aromatic group, and the aromatic group may contain a sulfonic acid group. One family of sulfates containing at least one polyalkylene oxide group which is useful in the plating baths of the invention is the family of sulfates from GAF Corporation under the general trade designation "Alipal". For example, Alipal CO-433 and Alipal EO-526 are sodium salts of sulfated nonylphenoxy poly(ethyleneoxy) ethanol; Alipal CO-436 is the analogous ammonium salt, and Alipal CD-128 and AB-436 are ammonium salts of ethoxylate sulfates.

Ethoxylated naphthols which can be treated with sulfuric acid to form the sulfate/sulfonate compounds useful in the plating baths of the invention are the polyoxyalkylated naphthols which are obtained by reacting a naphthol with an alkylene oxide such as ethylene oxide and propylene oxide and more particularly, with from about 6 to about 40 moles of ethylene oxide per mole of naphthol. The naphthol reactant may be either alpha or beta naphthol and the naphthalene ring may contain various substituents such as alkyl groups or alkoxy groups, especially lower alkyl and lower alkoxy groups of up to about 7 carbon atoms each, so long as the product of the sulfonation reaction remains bath-soluble. When present, there usually will not be more than two such substituents per polyoxyalkylated naphthol. The preferred polyoxyalkylated naphthols are the ethoxylated naphthols having the formula

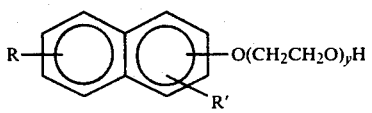

(XVI)

wherein y is from 6 to about 40 and preferably from about 8 to about 20, and R and R′ are each independently hydrogen, alkoxy or alkyl groups containing up to 7 carbon atoms. Derivatives of beta naphthol are preferred.

When alkoxylated naphthols of the type represented by formula XVI are reacted with sulfuric acid, the terminal hydroxyl group is sulfated and the naphthol ring is sulfonated providing a product containing both sulfate and sulfonate groups. An example of a polyalkylene oxide sulfate which also contains a sulfonic acid group is the product obtained as a result of the following procedure. The composition obtained by condensing one equivalent of beta-naphthol with ten equivalents of ethylene oxide (10 grams) is added dropwise to 10 grams of reagent grade sulfuric acid (assay 96% $H_2SO_4$, 98 millimoles). During the addition agitation is maintained, and the solution turns dark in color, becomes viscous and the temperature eventually reaches 70° C. The solution is allowed to stand overnight and is poured with stirring into 200 ml. of water. This solution is neutralized with 50% sodium hydroxide, and the water is removed on a Buchi Rotavapor. The residue is washed thoroughly with acetone to remove unreacted condensate. The product is dissolved in 95% ethanol leaving insoluble sodium sulfate. The ethanol solution can be used directly in plating or the ethanol can be removed prior to addition of the product to the plating bath. Nuclear magnetic resonance spectroscopy indicates a high percentage of the naphthalene rings are sulfonated.

The brightness of the cadmium deposit obtained with the plating baths and process of the invention is improved when the plating bath contains at least one organic brightener composition in concentrations of from about 0.1 to about 20 grams per liter of bath. The organic brightener compounds can be pyridine compounds or aromatic carbonyl-containing compounds or mixtures thereof. Preferably, the plating baths of the invention will contain a pyridine compound as a brightener or a combination of a pyridine compound and an aromatic carbonyl-containing compound.

The pyridine compounds which are the preferred brighteners in the plating baths of the invention have the formula

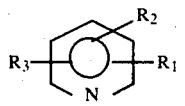

(I)

wherein $R_1$, $R_2$ and $R_3$ are each independently hydrogen, alkyl, alkoxy, alkene, mercapto, amino, halogen, aryl, arylalkyl, aminoalkyl, hydroxy, hydroxyalkyl, cyano, dialkylamide, aldoxime, benzo (b), pyrrolidinyl groups and the corresponding N-oxide compounds. The alkyl, alkoxy and alkene groups will generally be lower alkyl, alkoxy or alkene groups containing up to six carbon atoms. The aryl groups may contain one or more groups attached to the aromatic moiety including lower alkyl, hydroxy, amino and halogen groups.

The pyridine compounds of the type represented by formula I are available and well known compounds. For example, most of the compounds listed in Table I below are available from the Aldrich Chemical Company, Milwaukee, Wis. Mixtures of the pyridine compositions may be included in the plating baths. The amount of pyridine composition included in the cadmium baths of the invention is an amount which is effective to provide a bright or semi-bright and level cadmium deposit as desired. Generally amounts of from about 0.05 to 10 grams per liter of bath will provide satisfactory semi-bright to bright deposits over a wide current density range.

TABLE I

Pyridine Brightener Compounds 4-pyridine aldoxime
3,4-dimethylpyridine
4-benzylpyridine
3-bromopyridine
Quinoline (Benzo (b) pyridine)
Quinaldine
3-picoline-N-oxide
2-aminopyridine
3-aminopyridine
2,6-diaminopyridine
3-picoline
4-picoline
3-aminomethylpyridine
2-amino-4-picoline
2-amino-3-hydroxy-pyridine
3-chloropyridine
3,5-dichloropyridine
4-tert-butylpyridine
4-bromopyridine
3-cyanopyridine
N,N-diethylnicotinamide pyridine
2,6-dimethoxypyridine
3-hydroxypyridine
4-vinylpyridine
4-methoxypyridine
3-pyridylcarbinol-N-oxide
3,5-lutidine
4-mercaptopyridine
2-methoxypyridine
2,4-lutidine
2,4,6-collidine
benzoyl pyridine The following compounds illustrate the types of aromatic carbonyl containing compounds which are useful as brighteners in the plating baths of the invention, and these carbonyl compounds include aldehydes as well as ketones, carboxylic acids, esters or amides or bath-soluble salts of carboxylic acids or amides.

Preferred examples of the aromatic aldehydes which have been found useful are the naphthaldehydes and benzaldehydes. It is preferred that the benzaldehydes contain at least one chloro substituent. Examples of aromatic aldehydes which may be utilized in the plating baths of the invention include o-chlorobenzaldehyde; 2,4-dichlorobenzaldehyde; 3,4-dichlorobenzaldehyde, 3,5-dichlorobenzaldehyde; cinnamaldehyde; and anisaldehyde. Examples of the naphthaldehydes include 1-naphthaldehyde; 2-ethoxy-1-naphthaldehyde; 4-methoxy-1-naphthaldehyde; 4-ethoxy-1-naphthaldehyde; and 4-hydroxy-1-naphthaldehyde. Examples of ketones include benzylidene acetone, coumarin, acetophenone, propiophenone and 3-methoxybenzal acetone. Other carbonyl compounds include furfurylidene acetone, 3-indole carboxaldehyde and thiophene carboxaldehyde.

Examples of useful carboxylic acids and salts, ester, amides, include benzoic acid, sodium salicylate, 3-pyridine carboxylic acid, benzamide, ethyl benzoate, propyl benzoate. The benzoic and salicylic acids and salts are preferred.

Mixtures of one or more of the aldehydes with one or more ketones also are useful. When employed in the baths of the invention, the carbonyl-containing brighteners will be included within the range of from about 0.02 to about 1 gram per liter and preferably from about 0.03 to about 0.5 gram per liter of bath.

Aromatic sulfonic acids or salts also are useful additives to the plating baths and these include the acids and salts having the general formula

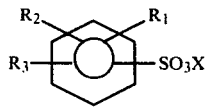

(XII)

or

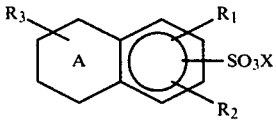

(XIII)

wherein $R_1$, $R_2$ and $R_3$ are each independently hydrogen or lower alkyl groups, X is hydrogen, ammonium or any metal with the proviso that the metal sulfonate is soluble in the bath, and A is a saturated, unsaturated or aromatic ring.

As can be seen from the formulas, the sulfonic acids may be derived from benzene sulfonic acids, naphthalene sulfonic acids and di- or tetrahydronaphthalene sulfonic acids. The lower alkyl groups may be straight or branched chain and may contain up to about 6 carbon atoms. The aromatic sulfonic acids and salts of formula XII containing two alkyl groups have been found to be particularly effective in the acid plating baths of the invention. Of the metals included in the salts of the sulfonic acids, the alkali metals, particularly sodium, are preferred.

Examples of aromatic sulfonic acids which are useful in the acid plating baths of the invention include benzene sulfonic acid, toluene sulfonic acid, isopropylbenzene sulfonic acid, xylene sulfonic acid, diethylbenzene sulfonic acid, naphthalene sulfonic acid, methylnaphthalene sulfonic acid, dimethylnaphthalene sulfonic acid, tetrahydrophthalene sulfonic acid, etc. The aromatic sulfonic acids preferably are added to the acid cadmium plating baths in the form of their salts which may be metal salts or an ammonium salt. Any metal can be used to form the metal salts of the aromatic sulfonic acids so long as the metal does not cause any detrimental effects in the plating bath or render the sulfonates insoluble in the plating bath.

Some commercially available examples of aromatic sulfonic acids which may be used include: a bath-soluble salt of tetrahydronaphthalene sulfonic acid such as those available from duPont; a bath-soluble salt of a xylene sulfonic acid such as those available from Arco Chemical Company under the general trade designation "Ultrawet"; an alkyl aryl sulfonate available from duPont under the trade designation "Alkanol TD"; and a bath-soluble salt of cumyl sulfonic acid.

The anionic aromatic sulfonic acids included in the baths of the invention also may be compounds obtained by the polycondensation of formaldehyde and an aromatic sulfonic acid. Condensation products of this type which are useful in the plating baths of the invention have the formula

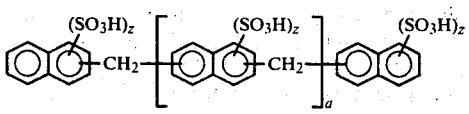

(XIV)

and/or

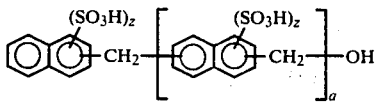

(XV)

wherein each z is independently an integer from 1 to 3 and each a is independently an integer from 1 to 14, preferably from 2 to 6. Polycondensation products of this type are known compounds and their production is described in, for example, Houben-Weyl, "Methoden Der Organishen Chemie", Volume XIV/2 at page 316, and said description is hereby incorporated by reference. The utility of anionic aromatic sulfonic acid products in acid cadmium baths is described in U.S. Pat. Nos. 3,998,707 and 4,045,305. Compounds of these types are available commercially from a variety of sources.

The general method of preparing these polycondensation products involves reaction of a formaldehyde solution with naphthalene sulfonic acid at a temperature of from about 60° to about 100° C. until the formaldehyde odor has disappeared. Similar products can be obtained by sulfonation of naphthalene formaldehyde resins. The condensation products obtained in this manner contain two or more naphthalene sulfonic acids linked by methylene bridges which can have from one to three sulfonic acid groups.

These condensed aromatic sulfonic acid compounds may be introduced into the plating baths either in their acid form or as the water-soluble salts which may be the sodium or potassium salts.

The amount of the above-described aromatic sulfonic acid and condensed aromatic sulfonic acid compounds included in the cadmium plating baths of the invention may be varied depending on the other ingredients in the plating bath but should be an amount which is effective to improve the brightness, and preferably also the ductility and malleability of the cadmium deposit obtained from the baths. Generally amounts of from about 0.05 to about 20 grams are included per liter of plating bath.

The properties of the cadmium deposited from the aqueous acidic baths of the invention may be enhanced further by including in the bath at least one nonionic polyoxyalkylene compound. A preferred type of such compound is the polyoxyalkylated naphthols which are obtained by reacting a naphthol with an alkylene oxide such as ethylene oxide and propylene oxide, and more particularly, with from about 6 to about 40 moles of ethylene oxide per mole of naphthol. The naphthol reactant may be either alpha or beta naphthol and the naphthalene ring may contain various substituents such as alkyl groups or alkoxy groups, especially lower alkyl and lower alkoxy groups of up to about 7 carbon atoms each, so long as the polyoxyalkylated naphthol remains bath-soluble. When present, there usually will not be more than two such substituents per polyoxyalkylated naphthol; that is, two lower alkoxy groups, two lower alkyl groups, or a lower alkyl or a lower alkoxy group. The preferred polyoxyalkylated naphthols are ethoxylated naphthols having the formula

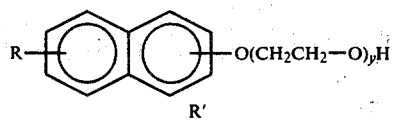

(XVI)

wherein y is from about 6 to about 40 and preferably from about 8 to about 20 and R and R' are each independently hydrogen, alkoxy or alkyl groups containing up to 7 carbon atoms. Derivatives of beta naphthol are preferred. The amount of polyoxyalkylated naphthol, when included in the baths of the invention, may vary within the range of from about 0.1 to about 20 grams or more per liter of bath.

The cadmium plating baths may contain, in lieu of or in addition to the ethoxylated naphthols described above, one or more nonionic or cationic alkylene oxide condensate surfactants. Examples of such surfactants include ethoxylated alkyl phenols, ethoxylated fatty alcohols, ethoxylated fatty acids, ethoxylated fatty acid amides, ethoxylated fatty amines, polyethylene oxide condensates, block copolymers of ethylene oxide and propylene oxide based on propylene glycol or ethylene glycol, and sulfonated ethoxylated aliphatic amines. Generally the surfactants will contain up to about 40 or more ethylene oxide units. These types of surfactants have been described above as examples of alkylene oxide condensates used in the preparation of the phosphates, carboxylates, sulfonates and sulfates used in the baths of the invention. The amount of nonionic or cationic ethylene oxide condensate included in the baths of the invention may vary over a wide range although when added to the bath it is preferred to include from about 0.5 to about 10 g/l of the condensate in the bath.

The cadmium plating baths of the invention may be utilized to produce bright to semi-bright cadmium deposits on all types of metals and alloys, for example, on iron (cast or malleable), steel, copper and brass. The electroplating baths may be employed in all types of industrial cadmium plating baths including still plating baths, high-speed plating baths for strip or wire plating, and in barrel plating.

The plating baths of the invention may be operated on a continuous or intermittent basis, and from time to time, the components of the bath may have to be replenished. The various components may be added singularly as required or may be added in combination. The amounts of the various compositions to be added to the plating baths may be varied over a wide range depending on the nature and performance of the plating bath to which the composition is added. Such amounts can be determined readily by one skilled in the art.

The following are examples of typical acid cadmium plating baths of the invention.

| | |
|---|---|
| Plating Bath A | |
| $Cd^{+2}$ | 15 g/l |
| $H_2SO_4$ | 40 g/l |
| Alipal CO-433 (sodium salt of a sulfated nonylphenoxy (ethyleneoxy) ethanol from GAF | 0.5 g/l |
| Ethoxylated beta naphthol (12 moles EtO) | 1.0 g/l |
| Niacin | 0.8 g/l |
| ortho-chlorobenzaldehyde | 0.1 g/l |
| water | to make 1 liter |
| Plating Bath B | |
| Plating Bath of A except the Alipal CO-433 is replaced by 1 g/l of Gafac RE960 (an anionic phosphate ester available from GAF) | |
| Plating Bath C | |
| Plating Bath A except the Alipal CO-433 is replaced by 0.3 g/l of Gafac RE960 and 0.3 g/l of Carbanone A (an ethoxylated secondary alcohol carboxylated with chloroacetic acid available from Hart Products) | |
| Plating Bath D | |
| $CdSO_4$ | 28 g/l |
| $H_2SO_4$ | 80 g/l |
| Alipal CO-433 | 1 g/l |
| Ethoxylated beta-naphthol (12 moles EtO) | 1 g/l |
| Sodium nicotinate | 2 g/l |
| ortho-chlorobenzaldehyde | 0.2 g/l |
| Blancol N (sodium salt of an ethoxylated sulfonated naphthalene condensate from GAF Corp. | 0.3 g/l |
| water | to make 1 liter |
| Plating Bath E | |
| Cd O | 30 g/l |
| Fluoboric acid (4% w.aqueous solution) | 180 ml/l |
| Sodium xylene monosulfonate | 4 g/l |
| Gafac RE960 | 0.5 g/l |
| water | to make 1 liter |
| Plating Bath F | |
| Cd $SO_4$ | 28 g/l |
| $H_2SO_4$ | 80 g/l |
| Gafac RE960 | 1.5 g/l |
| 3-picoline | 1.0 g/l |
| Blancol N | 0.3 g/l |
| water | to make 1 liter |
| Plating Bath G | |
| $CdSO_4$ | 28 g/l |
| $H_2SO_4$ | 80 g/l |
| Carbanone A | 1.5 g/l |
| 3-picoline | 1.0 g/l |
| Blancol N | 0.3 g/l |
| water | to make 1 liter |
| Plating Bath H | |
| $CdSO_4$ | 28 g/l |

-continued

| | |
|---|---|
| $H_2SO_4$ | 80 g/l |
| Reaction product of ethoxylated beta naphthol (12 moles EtO) and $H_2SO_4$ | 1.5 g/l |
| Blancol N | 0.5 g/l |
| water | to make 1 liter |
| Plating Bath I | |
| $CdSO_4$ | 28 g/l |
| $H_2SO_4$ | 80 g/l |
| Alipal CO-433 | 1.0 g/l |
| Blancol N | 0.3 g/l |
| 3-picoline | 1.0 g/l |
| water | to make 1 liter |
| Plating Bath J | |
| $CdSO_4$ | 28 g/l |
| $H_2SO_4$ | 80 g/l |
| Alipal CO-433 | 0.15 g/l |
| Ethoxylated beta-naphthol (12 moles EtO) | 1.0 g/l |
| pyridine | 1.0 g/l |
| water | to make 1 liter |
| Plating Bath K | |
| $CdSO_4$ | 28 g/l |
| $H_2SO_4$ | 80 g/l |
| Gafac RE960 | 0.5 g/l |
| Alipal CO-433 | 0.15 g/l |
| 3-picoline | 1.0 g/l |
| water | to make 1 liter |

Plating bath formulations of the type described in the above Examples provide satisfactory bright cadmium deposits. Plating baths containing brighteners as described above generally produce semi-bright to bright plate over a wide current density range. For example, Bath A produces semi-bright to bright plate from below 2 amps/dm$^2$ to above 8.0 amp/dm$^2$.

The following compositions are examples of additive compositions which can be used for preparing a bath or for addition to a working plating bath in accordance with the invention.

| | % by volume |
|---|---|
| Additive Composition I | |
| Alipal CO-433 | 5% |
| Ethoxylated beta-naphthol (12 moles EtO) | 10% |
| Pyridine | 10% |
| Water | 75% |
| pH | 1.0 |
| Additive Composition II | |
| Gafac RE960 | 10% |
| Carbanone A | 10% |
| 3-picoline | 10% |
| Water | 70% |
| pH | 1.0 |
| Additive Composition III | |
| Alipal CO-433 | 10% |
| Ethoxylated beta-naphthol (12 moles EtO) | 10% |
| Sodium nicotinate | 5% |
| ortho-chlorobenzaldehyde | 5% |
| Methanol | 10% |
| Water | 60% |
| Additive Composition IV | |
| Product of ethoxylated beta-naphthol (12 moles EtO) with sulfuric acid | 10% |
| Blancol N | 5% |
| Ethoxylated beta-naphthol (12 moles EtO) | 10% |
| Water | 75% |

We claim:

1. An aqueous electroplating bath for the electrodeposition of cadmium comprising (a) cadmium ions, (b) a free acid, and (c) at least one phosphate, carboxylate, or sulfate compound containing one or more alkylene oxide groups and wherein the alkylene group contains 2 or 3 carbon atoms, and at least one of the alkylene oxide groups in the sulfates is attached to an aryl group.

2. The plating bath of claim 1 wherein the bath also contains (d) at least one organic brightener compound.

3. The plating bath of claim 2 wherein the brightener compound is selected from the group consisting of pyridines and aromatic carbonyl-containing compounds.

4. The plating bath of claim 3 wherein the pyridine brightener has the formula

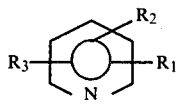

(I)

wherein $R_1$, $R_2$ and $R_3$ are each independently hydrogen, alkyl, alkoxy, alkene, mercapto, amino, halogen, aryl, arylalkyl, aminoalkyl, hydroxy, hydroxyalkyl, cyano, dialkylamide, aldoxime, benzo (b), pyrrolidinyl groups and the corresponding N-oxide compounds.

5. The plating bath of claim 2 wherein the bath contains from about 0.05 to about 10 grams of the brightener composition per liter of bath.

6. The plating bath of claim 1 wherein the free acid is sulfuric, fluoboric acid or mixtures thereof.

7. The plating bath of claim 1 wherein the bath also contains (e) at least one aromatic sulfonic acid or condensed aromatic sulfonic acid.

8. The plating bath of claim 1 wherein the bath contains a condensed naphthalene sulfonic acid.

9. The plating bath of claim 1 wherein the bath also contains at least one nonionic polyoxyalkylene compound.

10. The plating bath of claim 9 wherein the nonionic polyoxyalkylene compound is a polyethoxylated naphthol having the formula

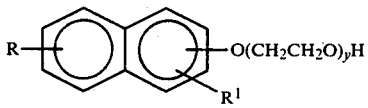

(XVI)

wherein y is an integer from about six to about 40, and R and $R^1$ are each independently hydrogen, alkoxy or alkyl groups containing up to seven carbon atoms.

11. The plating bath of claim 1 wherein the phosphate compound has the formula

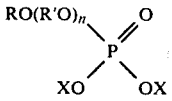

(II)

wherein

R is an alkyl or aryl group containing up to about 24 carbon atoms, each R′ independently is an alkylene group or mixture of alkylene groups containing 2 or 3 carbon atoms, n is an integer from one to about 100, and each X independently is hydrogen, a metal, ammonium or protonated amine, or each OX independently is $RO(R'O)_n$—.

12. The plating bath of claim 11 wherein R is an alkyl phenyl group containing up to 18 carbon atoms in the alkyl group.

13. The plating bath of claim 1 wherein the carboxylate compound has the formula $$RO(R'O)_nR''COOX \qquad \text{(III)}$$

wherein

R is an alkyl or aryl group containing up to about 24 carbon atoms,

R′ is an alkylene group or mixture of alkylene groups containing two or three carbon atoms, R″ is an alkylene group containing from one to about 20 carbon atoms, n is an integer from one to about 100, and X is hydrogen, a metal, ammonium or a protonated amine.

14. The plating bath of claim 13 wherein the carboxylate compound has the formula $$R^2R^3C(H)O(CH_2CH_2O)_nCH_2CO_2M$$

wherein $R^2$ and $R^3$ are each independently lower alkyl groups containing up to about six carbon atoms, n is an integer and M is an alkali metal or ammonium ion.

15. The plating bath of claim 1 wherein the sulfate compound has the formula $$RO(R'O)_n—SO_2—Y \qquad \text{(IV)}$$

wherein

R is an aryl or alkylaryl group,

R′ independently is an alkylene group or mixture of alkylene groups containing two or three carbon atoms, n is an integer from one to about 100, and Y is $RO(R'O)_n$ or OM wherein M is hydrogen, a metal, ammonium or a protonated amine.

16. The plating bath of claim 15 wherein R is a naphthalene or sulfonated naphthalene group.

17. The plating bath of claim 1 wherein the phosphate, carboxylate, or sulfate compound is present in amounts of from 0.05 to about 20 grams per liter of bath.

18. A process of electrodepositing a cadmium coating on a substrate which comprises electroplating said substrate with a cadmium plating bath according to any one of claims 1–8.

19. An aqueous electroplating bath for the electrodeposition of cadmium comprising (a) cadmium ions, (b) a free acid, (c) at least one phosphate, carboxylate, sulfonate or sulfate compound containing one or more alkylene oxide groups and wherein the alkylene group contains 2 or 3 carbon atoms, and at least one of the alkylene oxide groups in the sulfates is attached to an aryl group, and (d) at least one organic brightener compound selected from the group consisting of pyridines and aromatic carbonyl-containing compounds.

20. The plating bath of claim 19 wherein the pyridine brightener has the formula

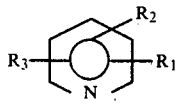

(I)

wherein $R_1$, $R_2$ and $R_3$ are each independently hydrogen, alkyl, alkoxy, alkene, mercapto, amino, halogen, aryl, arylalkyl, aminoalkyl, hydroxy, hydroxyalkyl, cyano, dialkylamide, aldoxime, benzo (b), pyrrolidinyl groups and the corresponding N-oxide compounds.

21. An aqueous electroplating bath for the electrodeposition of cadmium comprising (a) cadmium ions, (b) a free acid, (c) at least one phosphate, carboxylate, sulfonate or sulfate compound containing one or more alkylene oxide groups and wherein the alkylene group contains 2 or 3 carbon atoms, and at least one of the alkylene oxide groups in the sulfates is attached to an aryl group, and (d) at least one aromatic sulfonic acid or condensed aromatic sulfonic acid.

22. The plating bath of claim 21 wherein the bath contains a condensed naphthalene sulfonic acid.

23. An aqueous electroplating bath for the electrodeposition of cadmium comprising (a) cadmium ions, (b) a free acid, (c) at least one phosphate, carboxylate, sulfonate or sulfate compound containing one or more alkylene oxide groups and wherein the alkylene group contains 2 or 3 carbon atoms, and at least one of the alkylene oxide groups in the sulfates is attached to an aryl group, and (d) at least one nonionic polyoxyalkylene compound.

24. The plating bath of claim 23 wherein the nonionic polyoxyalkylene compound is a polyethoxylated naphthol having the formula

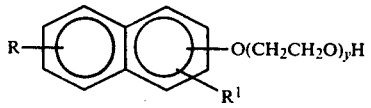

(XVI)

wherein y is an integer from about six to about 40, and R and $R^1$ are each independently hydrogen, alkoxy or alkyl groups containing up to seven carbon atoms.

25. The plating bath of any one of claims 19, 21 or 23 wherein the phosphate compound has the formula

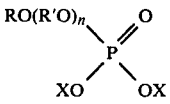

(II)

wherein

R is an alkyl or aryl group containing up to about 24 carbon atoms, each R′ independently is an alkylene group or mixture of alkylene groups containing 2 or 3 carbon atoms, n is an integer from one to about 100, and each X independently is hydrogen, a metal, ammonium or protonated amine, or each OX independently is $RO(R'O)_n$—.

26. The plating bath of any one of claims 19, 21 or 23 wherein the carboxylate compound has the formula $$RO(R'O)_nR''COOX \quad \text{(III)}$$

wherein

R is an alkyl or aryl group containing up to about 24 carbon atoms,

R′ is an alkylene group or mixture of alkylene groups containing two or three carbon atoms, R″ is an alkylene group containing from one to about 20 carbon atoms, n is an integer from one to about 100, and X is hydrogen, a metal, ammonium or a protonated amine.

27. The plating bath of any one of claims 19, 21 or 23 wherein the sulfate compound has the formula $$RO(R'O)_n—SO_2Y \quad \text{(IV)}$$

wherein

R is an aryl or alkylaryl group,

R′ independently is an alkylene group or mixture of alkylene groups containing two or three carbon atoms, n is an integer from one to about 100, and Y is $RO(R'O)_n$ or OM wherein M is hydrogen, a metal, ammonium or a protonated amine.

28. The plating bath of any one of claims 19, 21 or 23 wherein the phosphate, carboxylate, sulfonate, or sulfate compound is present in amounts of from 0.05 to about 20 grams per liter of bath.

* * * * *